US012507727B2

(12) United States Patent
Lee et al.

(10) Patent No.: US 12,507,727 B2
(45) Date of Patent: Dec. 30, 2025

(54) AEROSOL GENERATING ARTICLE AND AEROSOL GENERATING SYSTEM

(71) Applicant: KT&G CORPORATION, Daejeon (KR)

(72) Inventors: Won Kyeong Lee, Gyeonggi-do (KR); Heon Jun Jeong, Seoul (KR); Jae Sung Choi, Gyeonggi-do (KR)

(73) Assignee: KT&G Corporation, Daejeon (KR)

( * ) Notice: Subject to any disclaimer, the term of this patent is extended or adjusted under 35 U.S.C. 154(b) by 42 days.

(21) Appl. No.: 17/794,512

(22) PCT Filed: Apr. 18, 2022

(86) PCT No.: PCT/KR2022/005510
§ 371 (c)(1),
(2) Date: Nov. 3, 2022

(87) PCT Pub. No.: WO2022/231187
PCT Pub. Date: Nov. 3, 2022

(65) Prior Publication Data

US 2024/0188626 A1 Jun. 13, 2024

(30) Foreign Application Priority Data

Apr. 30, 2021 (KR) ..... 10-2021-0056871

(51) Int. Cl.
*A24D 1/20* (2020.01)
*A24D 1/22* (2020.01)
(Continued)

(52) U.S. Cl.
CPC ..... *A24D 1/20* (2020.01); *A24D 1/22* (2020.01); *A24F 40/20* (2020.01); *A24F 40/465* (2020.01)

(58) Field of Classification Search
None
See application file for complete search history.

(56) References Cited

U.S. PATENT DOCUMENTS 4,819,665 A 4/1989 Roberts et al.
10,159,277 B2 12/2018 Bonnely
(Continued)

FOREIGN PATENT DOCUMENTS

CN 88100383 A 8/1988
CN 105407749 A 3/2016
(Continued)

OTHER PUBLICATIONS

International Search Report issued Aug. 1, 2022 in International Application No. PCT/KR2022/005510.
(Continued)

*Primary Examiner* — Philip Y Louie
*Assistant Examiner* — Madeleine P Delacruz
(74) *Attorney, Agent, or Firm* — Foley & Lardner LLP

(57) ABSTRACT

An aerosol generating article includes a heat source portion including a combustible heat source for generating heat; a heat conduction portion connected to the heat source portion and including an inlet hole through which external air is introduced; a tobacco medium connected to the heat conduction portion and heated by the heat of the heat source transferred through the heat conduction portion, to include an aerosol generating material for generating an aerosol; and a first heat conductor disposed in the tobacco medium and including a heat-conducting material for transferring heat generated by the heat source portion to the tobacco medium.

15 Claims, 5 Drawing Sheets

(51) Int. Cl.

| | |
|---|---|
| ***A24F 40/20*** | (2020.01) |
| ***A24F 40/46*** | (2020.01) |
| ***A24F 40/465*** | (2020.01) |
| ***A24F 42/00*** | (2020.01) |

(56) References Cited

U.S. PATENT DOCUMENTS

| | | | | |
|---|---|---|---|---|
| 10,426,194 | B2 | 10/2019 | Nakano et al. | |
| 10,542,776 | B2 | 1/2020 | Lavanchy et al. | |
| 10,849,357 | B2 | 12/2020 | Roudier et al. | |
| 2013/0133675 | A1 | 5/2013 | Shinozaki et al. | |
| 2015/0053219 | A1* | 2/2015 | Roudier | A24F 42/10 131/329 |
| 2015/0359259 | A1 | 12/2015 | Conner et al. | |
| 2016/0174609 | A1* | 6/2016 | Mironov | A24B 15/165 131/329 |
| 2016/0192704 | A1 | 7/2016 | Bonnely | |
| 2016/0331032 | A1 | 11/2016 | Malgat et al. | |
| 2017/0055577 | A1* | 3/2017 | Batista | A24B 15/165 |
| 2018/0014574 | A1 | 1/2018 | Rogan | |
| 2019/0261678 | A1 | 8/2019 | Conner et al. | |
| 2020/0323259 | A1* | 10/2020 | Duc | A24D 1/22 |
| 2021/0052010 | A1* | 2/2021 | Duc | A24F 42/10 |
| 2021/0244094 | A1* | 8/2021 | Gallagher | A24F 40/46 |
| 2022/0183379 | A1* | 6/2022 | Illidge | A24F 40/485 |
| 2022/0295871 | A1* | 9/2022 | Joyeux | A24B 15/14 |
| 2024/0049783 | A1* | 2/2024 | Li | A24D 1/20 |

FOREIGN PATENT DOCUMENTS

| | | | |
|---|---|---|---|
| CN | 108158029 | A | 6/2018 |
| CN | 111526742 | A | 8/2020 |
| CN | 112273730 | A | 1/2021 |
| CN | 212414723 | U | 1/2021 |
| EP | 0 212 234 | A2 | 3/1987 |
| EP | 3 862 631 | A1 | 8/2021 |
| KR | 97-56516 | U | 11/1997 |
| KR | 10-2014-0132711 | A | 11/2014 |
| KR | 10-2016-0042417 | A | 4/2016 |
| KR | 10-2016-0052534 | A | 5/2016 |
| KR | 10-2016-0094938 | A | 8/2016 |
| KR | 10-1930194 | B1 | 12/2018 |
| KR | 10-2020-0008846 | A | 1/2020 |
| KR | 10-2021-0043286 | A | 4/2021 |
| WO | 2014/037270 | A1 | 3/2014 |
| WO | 2020/017819 | A1 | 1/2020 |
| WO | 2020/070844 | A1 | 4/2020 |

OTHER PUBLICATIONS

Office Action issued May 25, 2023 in Korean Application No. 10-2021-0056871.

Extended European Search Report issued Jul. 11, 2023 in European Application No. 22744369.4.

Chinese Office Action on Patent Application No. 202280002309.7 dated Apr. 17, 2025.

* cited by examiner

[Fig. 1]
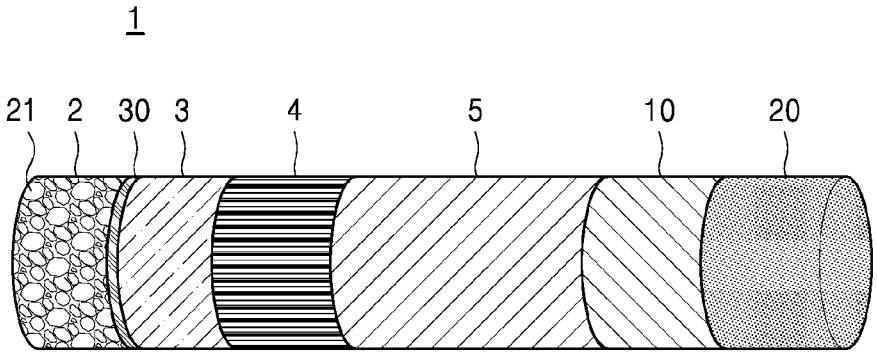
[Fig. 2]
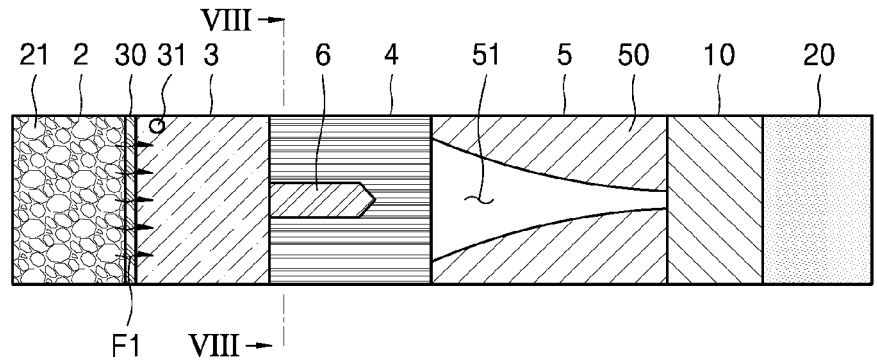
[Fig. 3]
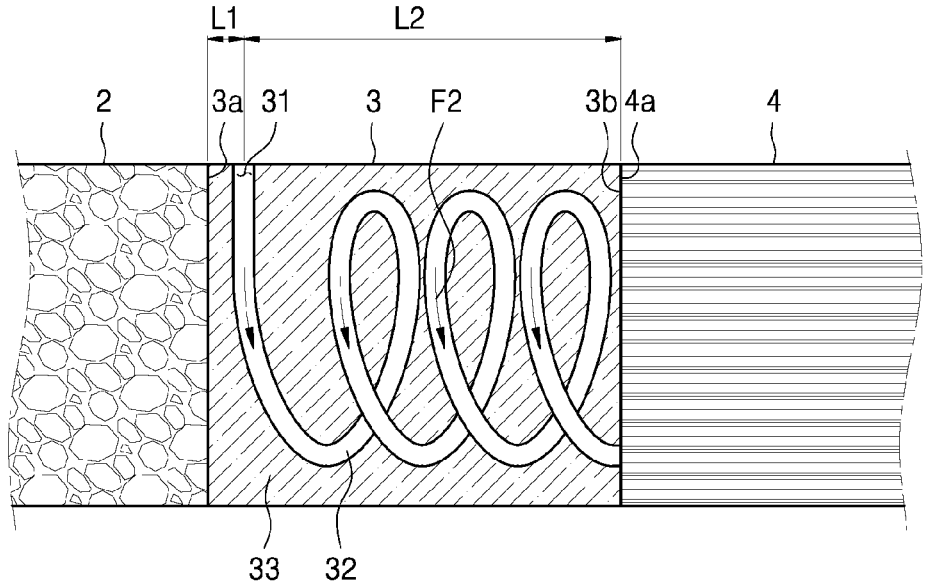

[Fig. 4]
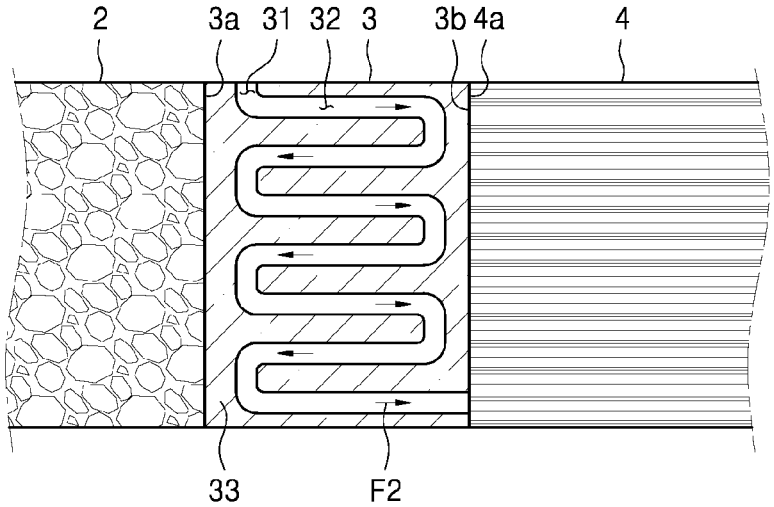
[Fig. 5]
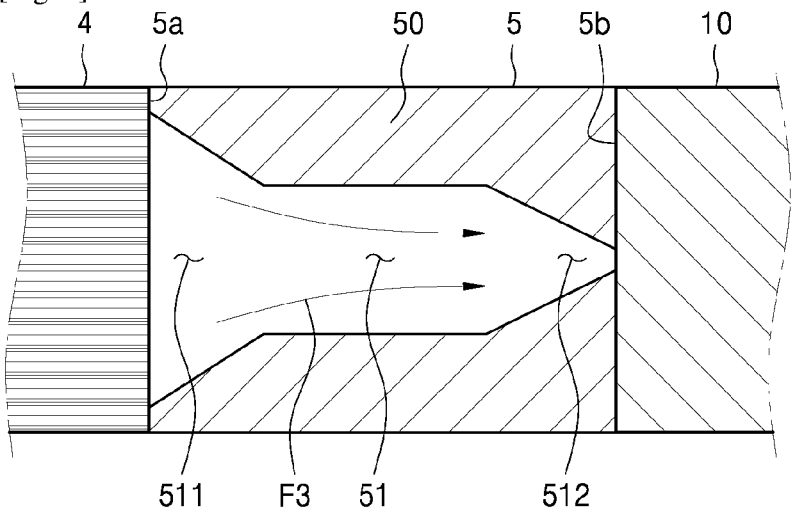
[Fig. 6]
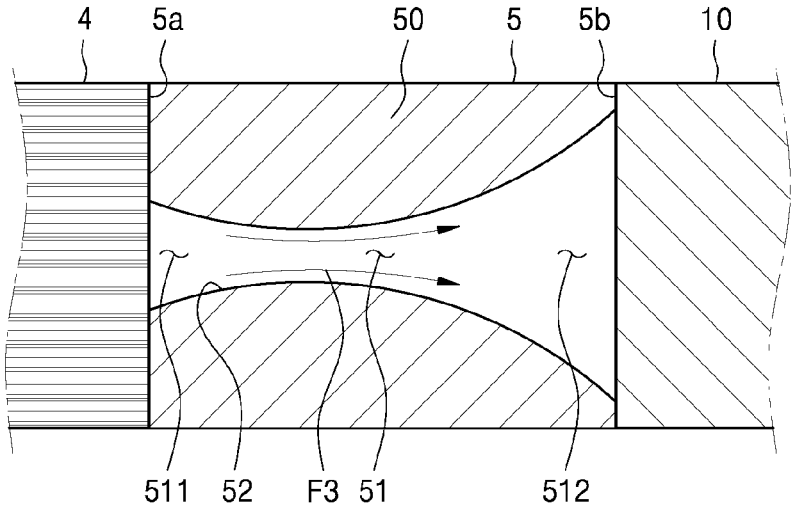

[Fig. 7]
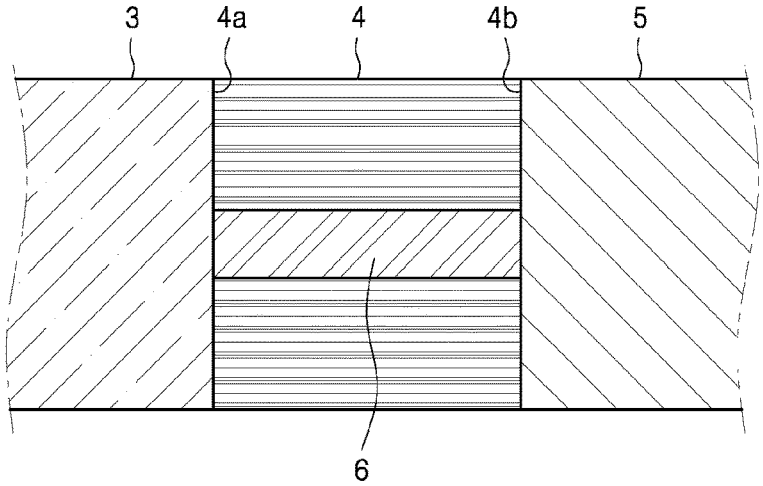
[Fig. 8]
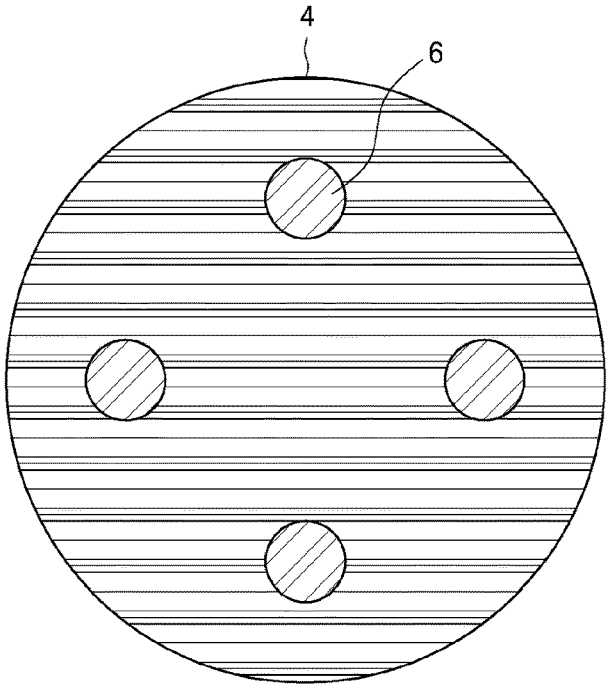
[Fig. 9]
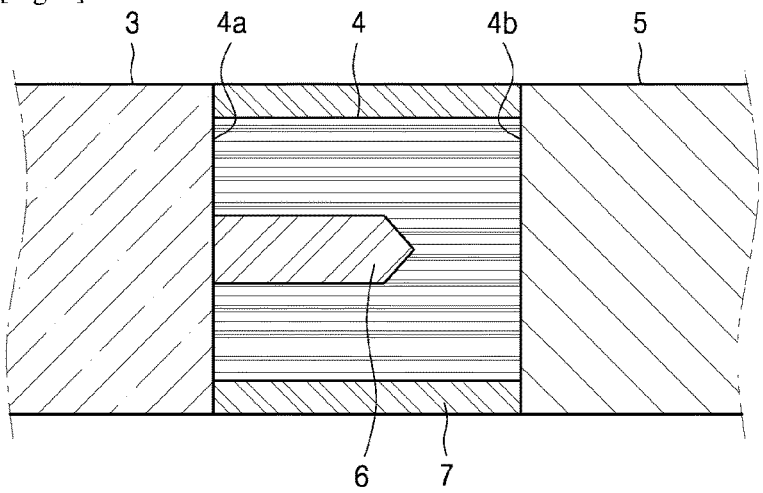

[Fig. 10]
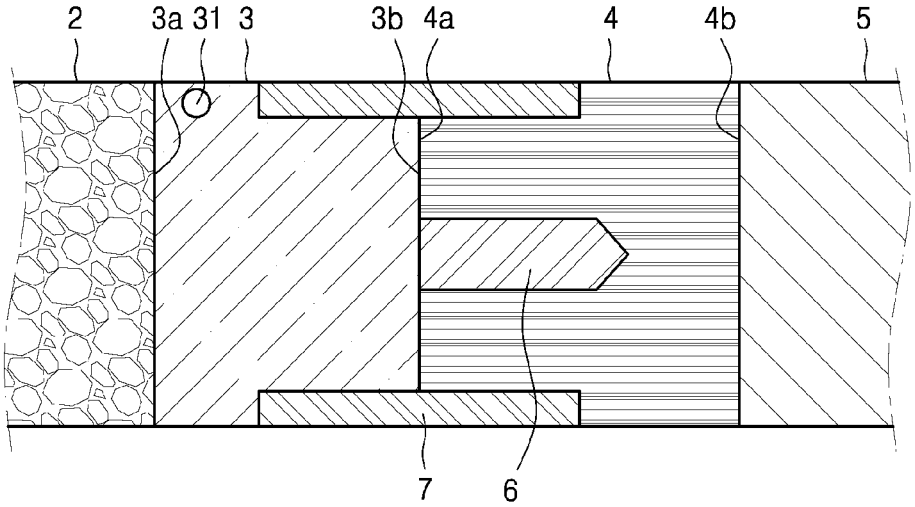
[Fig. 11]
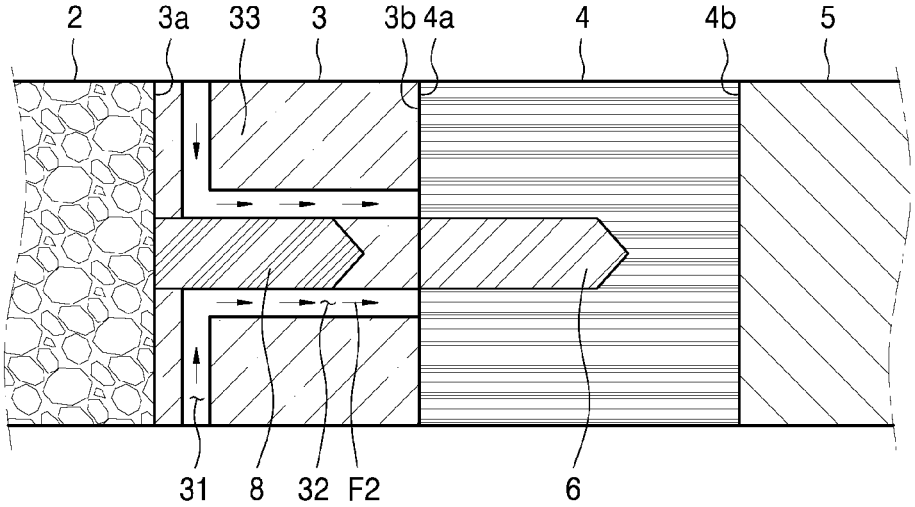
[Fig. 12]
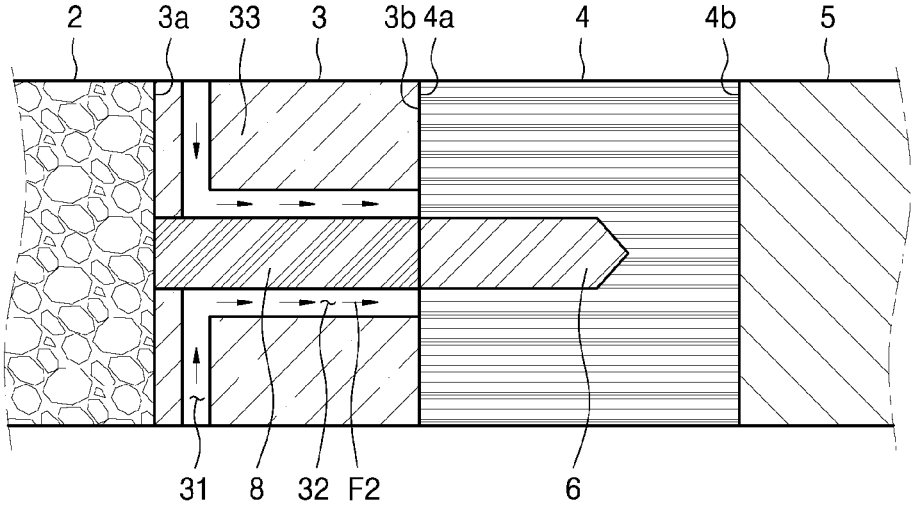

[Fig. 13]
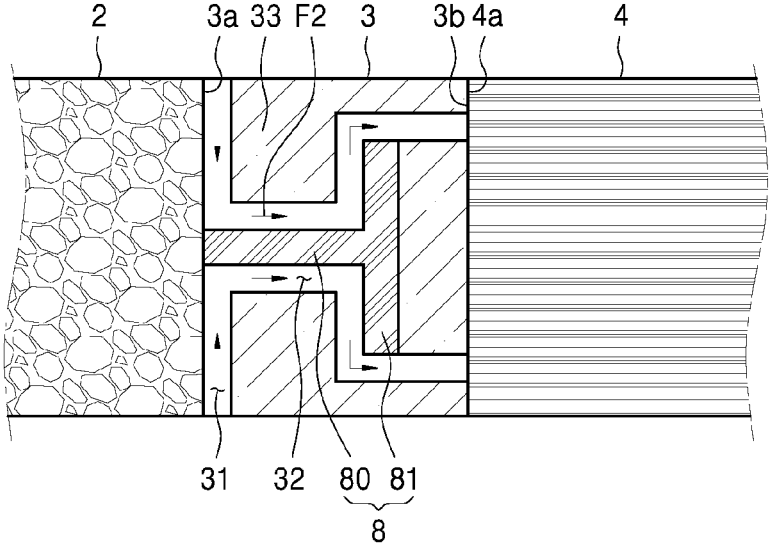
[Fig. 14]
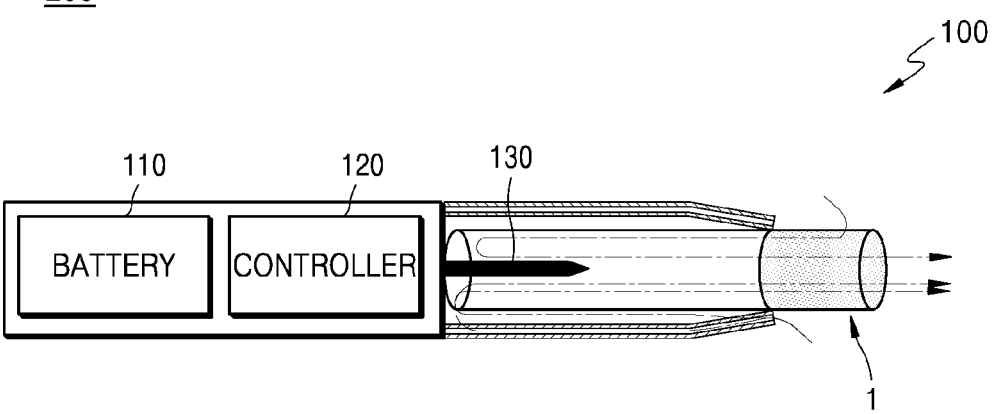
[Fig. 15]
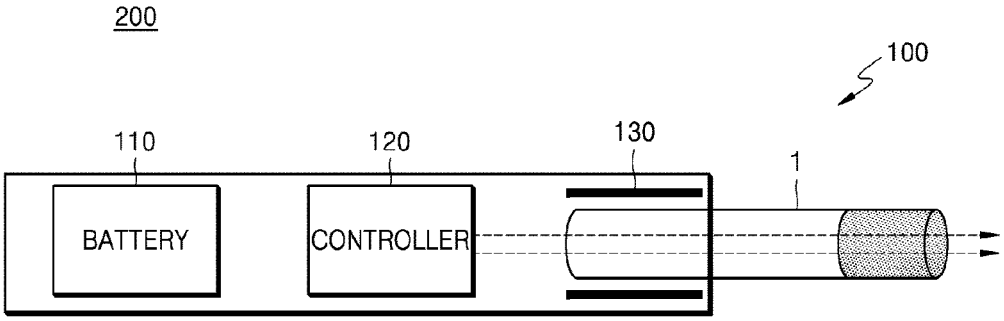

AEROSOL GENERATING ARTICLE AND AEROSOL GENERATING SYSTEM

CROSS REFERENCE TO RELATED APPLICATIONS

This application is a National Stage of International Application No. PCT/KR2022/005510 filed Apr. 18, 2022, claiming priority based Korean Patent Application 10-2021-0056871 filed on Apr. 30, 2021 the contents of all of which are incorporated herein by reference in their entirety.

TECHNICAL FIELD

The embodiments relate to an aerosol generating article and an aerosol generating system, and more particularly, to an aerosol generating article and an aerosol generating system capable of increasing an amount of heat transferred to a tobacco medium and improving a fluidity of an aerosol.

BACKGROUND ART

Recently, the demand for alternative methods to overcome the disadvantages of traditional cigarettes has increased. For example, there is growing demand for an aerosol generating device which generates aerosol by heating an aerosol generating material, rather than by combusting cigarettes. Accordingly, researches on a heating-type aerosol generating device has been actively conducted.

DISCLOSURE OF INVENTION

Technical Problem

Many aerosol generating articles include a heat source that generates heat upon ignition. Such an aerosol generating article generates an aerosol by heating an aerosol generating material included in a tobacco medium with the heat generated by the heat source.

However, there is a problem that it takes a long time until the aerosol is generated from the aerosol generating material and provided to the user because of the insufficient amount of heat reaching the tobacco medium.

Solution to Problem

Embodiments provide an aerosol generating article and an aerosol generating system capable of increasing an amount of heat transferred to the tobacco medium and improving a fluidity of an aerosol.

Advantageous Effects of Invention

The aerosol generating article and the aerosol generating system according to the embodiments as described above may increase an amount of heat transferred to a tobacco medium and improve a fluidity of an aerosol generated by the tobacco medium.

In addition, the aerosol generating article and the aerosol generating system according to the embodiments can maintain the tobacco medium at a relatively high temperature, so that an aerosol is easily generated from an aerosol generating material included in the tobacco medium.

In addition, the aerosol generating article and the aerosol generating system according to the embodiments may be implemented so that the tobacco medium is not easily broken even if an external force such as an impact acts on the tobacco medium.

BRIEF DESCRIPTION OF DRAWINGS

FIG. 1 is a schematic perspective view of an aerosol generating article according to an embodiment.

FIG. 2 is a schematic front cross-sectional view of an aerosol generating article according to an embodiment.

FIG. 3 is a view showing an example of an airflow path inside a heat conduction portion.

FIG. 4 is a view showing another example of an airflow path inside a heat conduction portion.

FIG. 5 is a diagram illustrating an example of a movement passage through which an aerosol moves.

FIG. 6 is a view showing another example of a movement passage through which an aerosol moves.

FIG. 7 is a view showing an example of a first heat conductor arranged inside a tobacco medium.

FIG. 8 is a view illustrating a plurality of first heat conductors arranged inside a tobacco medium as viewed from line VIII-VIII of FIG. 2.

FIG. 9 is a view illustrating an example of a second heat conductor arranged on the outside of a tobacco medium.

FIG. 10 is a view illustrating an example of a second heat conductor disposed on the outside of a heat conduction portion and a tobacco medium.

FIG. 11 is a diagram illustrating an example of a third heat conductor arranged inside a heat conduction portion.

FIG. 12 is a diagram illustrating that a first heat conductor is connected to a third heat conductor.

FIG. 13 is a view illustrating another example of a third heat conductor arranged inside a heat conduction portion.

FIGS. 14 and 15 are views illustrating examples in which an aerosol generating article according to an embodiment is inserted into an aerosol generating device.

BEST MODE FOR CARRYING OUT THE INVENTION

Embodiments may implement aerosol generating articles and aerosol generating systems.

An aerosol generating article according to an embodiment includes a heat source portion including a combustible heat source for generating heat; a heat conduction portion connected to the heat source portion and including an inlet hole configured to introduce external air; a tobacco medium connected to the heat conduction portion, including an aerosol generating material that generates an aerosol when heated, and configured to receive the heat through the heat conduction portion; and a first heat conductor disposed in the tobacco medium and including a heat-conducting material for transferring heat generated by the heat source portion to the tobacco medium.

The first heat conductor may be inserted into the inside of the tobacco medium.

The first heat conductor may extend from one end of the tobacco medium to the other end of the tobacco medium.

A plurality of first heat conductors may be disposed in a circumferential direction of the tobacco medium.

The aerosol generating article may further include a second heat conductor surrounding at least a portion of the outer surface of the tobacco medium and at least a portion of an outer surface of the heat conduction portion.

The aerosol generating article may further include a third heat conductor that is disposed in the heat conduction portion and transfers heat generated from the heat source portion to at least one of the heat conduction portion and the tobacco medium.

The third heat conductor may include a shielding member extending in a direction transverse to the longitudinal direction of the heat conduction portion, and the heat conduction portion includes an airflow path connected to the inlet hole and including a portion extending along an extension direction of the third heat conductor extends in the extending direction.

The third heat conductor may extend from one end of the heat conduction portion to the other end of the heat conduction portion such that the third heat conductor is connected to the first heat conductor.

The heat conduction portion may include an airflow path that guides the external air introduced through the inlet hole to the tobacco medium, and the airflow path may extend in a direction transverse to the lengthwise direction of the heat conduction portion so that the external air introduced through the inlet hole moves in the circumferential direction of the heat conduction portion.

The heat conduction portion may include an airflow path that guides the external air introduced through the inlet hole to the tobacco medium, and the airflow path may include a portion that guides the external air introduced through the inlet hole in a direction from the tobacco medium toward the heat source portion.

The inlet hole may be disposed closer to the heat source portion than to the tobacco medium.

The aerosol generating article may further include an aerosol moving portion connected to the tobacco medium and including a movement passage through which the generated aerosol moves, wherein the aerosol moving portion may include a section in which a size of the movement passage decreases as a distance from the tobacco medium increases.

The aerosol generating article may further include an aerosol moving portion connected to the tobacco medium and including a movement passage through which the generated aerosol moves, wherein one end of the aerosol moving portion is connected to the tobacco medium, and the movement passage may include a first passage hole disposed at one end of the aerosol moving portion, and a second passage hole disposed at the other end of the aerosol moving portion and having a smaller size than the first passage hole.

The aerosol generating article may further include an aerosol moving portion connected to the tobacco medium and including a movement passage through which the generated aerosol moves, wherein the movement passage includes a curved surface configured to induce the aerosol to flow along the curved surface according to Coanda effect.

An aerosol generating system according to an embodiment may include an aerosol generating article according to an embodiment; and a heater configured to heat a heat source portion to generate heat from a heat source included in the heat source portion of the aerosol generating article.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

It will be understood that when an element or layer is referred to as being "over," "above," "on," "connected to" or "coupled to" another element or layer, it can be directly over, above, on, connected or coupled to the other element or layer or intervening elements or layers may be present.

The term "downstream" refers to a general direction in which the aerosol moves from where it is generated toward the mouth of a user in the aerosol generating article (e.g., cigarette) during smoking, and the term "upstream" refers to its opposite direction. The terms "downstream" and "upstream" may be used to indicate relative positions of components of the aerosol generating article. For example, a portion of a cigarette that is put in the user's mouth corresponds to a downstream end of the cigarette.

As used herein, expressions such as "at least one of," when preceding a list of elements, modify the entire list of elements and do not modify the individual elements of the list.

For example, the expression, "at least one of a, b, and c," should be understood as including only a, only b, only c, both a and b, both a and c, both b and c, or all of a, b, and c.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

FIG. 1 is a schematic perspective view of an aerosol generating article according to an embodiment, and FIG. 2 is a schematic front cross-sectional view of the aerosol generating article according to an embodiment.

An aerosol generating article 1 according to an embodiment includes a heat source portion 2, a heat conduction portion 3, a tobacco medium 4, and a first heat conductor 6. The heat source portion 2 may include a combustible heat source 21 for generating heat. The heat conduction portion 3 may be connected to the heat source portion 2 and may include an inlet hole 31 for introducing external air. The tobacco medium 4 may be connected to the heat conduction portion 3 and include an aerosol generating material that generates an aerosol when heated by the heat of the heat source portion 2. The first heat conductor 6 may be arranged inside the tobacco medium 4 and may include a heat-conducting material for transferring heat generated from the heat source 2 to the tobacco medium 4. Accordingly, the aerosol generating article 1 according to one embodiment may achieve the following effects.

First, the aerosol generating article 1 according to an embodiment may increase an amount of heat transferred to the tobacco medium 4 through the first heat conductor 6 including the heat-conducting material. Also, according to the aerosol generating article 1 according to an embodiment, the first heat conductor 6 may increase the temperature of the tobacco medium 4, thereby improving the fluidity of the aerosol generated by the tobacco medium 4.

Second, according to the aerosol generating article 1 according to an embodiment, the first heat conductor 6 may absorb heat transferred from the heat source portion 2 to maintain the temperature of the tobacco medium 4. Therefore, the aerosol generating article 1 according to one embodiment has the advantage of being able to relatively easily generate an aerosol from the aerosol generating material included in the tobacco medium 4.

Third, according to the aerosol generating article 1 according to an embodiment, the first heat conductor 6 is arranged in the tobacco medium 4, thereby supporting the tobacco medium 4. Therefore, even if an external force (e.g., an impact) acts on the tobacco medium 4, the tobacco medium 4 may not be easily broken.

Hereinafter, the heat source portion 2, the heat conduction portion 3, the tobacco medium 4, an aerosol moving portion 5, and the first heat conductor 6 are described in detail with reference to the accompanying drawings.

Referring to FIGS. 1 and 2, the heat source portion 2 includes a heat source 21 that generates heat.

One end (i.e., upstream end) of the heat source portion 2 may be exposed to the outside, and the other end (i.e., downstream end) of the heat source portion 2 may be connected to the heat conduction portion 3. The heat source portion 2 may be formed in a cylindrical shape as a whole, but this is an example and the heat source portion 2 may be formed in other shapes as long as the heat source portion 2 may include the heat source 21.

The heat source 21 may generate heat during ignition or combustion. The heat generated by the heat source 21 may sequentially move through the heat conduction portion 3, the tobacco medium 4, and the aerosol moving portion 5. The tobacco medium 4 may use heat generated by the heat source 21 to generate an aerosol from an aerosol generating material. The arrow F1 shown in FIG. 2 schematically shows the flow direction of the heat generated by the heat source portion 2.

The heat source 21 may include a combustible material. For example, the heat source 21 may include carbon. The heat source 21 may include 60% or more and 90% or less of carbon on a dry weight basis.

In addition to a combustible material, the heat source 21 may include additional elements such as tobacco ingredients (e.g., powdered tobacco or tobacco extract), flavoring agents, salts (e.g., sodium chloride, potassium chloride, or sodium carbonate), heat-stable graphite fibers, iron oxide powder, glass filaments, powdered calcium carbonate, alumina granules, and/or binders (e.g., guar gum or sodium alginate).

The heat source 21 may be manufactured in a variety of ways. For example, the heat source 21 may be extruded or compounded using pulverized or powdered carbon and may have a density greater than 0.5 g/cm$^3$ on a dry weight basis.

Although not shown in FIGS. 1 and 2, the heat source portion 2 may include an insertion hole through which a heater 130 (see FIG. 14) is inserted. When the aerosol generating article 1 according to an embodiment is inserted into an aerosol generating device 100, the heater 130 may be inserted into the insertion hole to be disposed inside the heat source portion 2. The heater 130 may ignite the heat source 21 using power supplied from a battery 110.

Referring to FIG. 2, a blocking coating 30 may be disposed between the heat source portion 2 and the heat conduction portion 3. The blocking coating 30 blocks the contact between the heat source 21 and the heat conduction portion 3, and prevents carbon monoxide or carbon dioxide generated from the heat source 21 from flowing into the heat conduction portion 3. The blocking coating 30 may be formed in the shape of a disk as a whole, but the shape of the blocking coating 30 is not limited thereto.

In addition, an air inlet groove (not shown) extending in the longitudinal direction (i.e., lengthwise direction) of the aerosol generating article 1 may be formed in the heat source portion 2. A plurality of air inlet grooves (not shown) may be formed on the outer surface of the heat source portion 2 along the circumferential direction. Hereinafter, a longitudinal direction (or a lengthwise direction) of any portion (e.g., heat conduction portion 3) of the aerosol generating article 1 refers to the longitudinal direction of the aerosol generating article 1.

In addition, the heat source portion 2 may include a susceptor (not shown) for induction heating. The susceptor may be disposed inside the heat source portion 2 and extend in the longitudinal direction. The susceptor may extend from one end of the heat source portion 2 to the other end of the heat source portion 2.

FIG. 3 is a diagram illustrating an example of an airflow path inside a heat conduction portion 3, and FIG. 4 is a diagram illustrating another example of an airflow path inside the heat conduction portion 3. The arrow F2 shown in FIGS. 3 and 4 schematically shows the flow direction of external air flowing through an airflow path 32.

Referring to FIGS. 1 to 4, the heat conduction portion 3 is connected to the heat source portion 2. One end 3*a* of the heat conduction portion 3 may be connected to the heat source portion 2, and the other end 3*b* of the heat conduction portion 3 may be connected to the tobacco medium 4. The heat conduction portion 3 may perform a function of transferring heat generated from the heat source portion 2 to the tobacco medium 4.

The heat conduction portion 3 may include an inlet hole 31 and the airflow path 32.

The inlet hole 31 is formed on the outer surface of the heat conduction portion 3 so that external air is introduced thereto, and may communicate with the airflow path 32 inside the heat conduction portion 3. The inlet hole 31 may be formed to extend in a direction transverse to the longitudinal direction of the aerosol generating article 1. The inlet hole 31 may be formed in the radial direction of the heat conduction portion 3.

The airflow path 32 is a passage through which air flows, and may be connected to each of the inlet hole 31 and the tobacco medium 4. As the air introduced into the inlet hole 31 flows through the airflow path 32, the heat generated by the heat source portion 2 may be transferred to the tobacco medium 4.

Referring to FIG. 3, the distance L1 between the one end 3*a* of the heat conduction portion 3 and the inlet hole 31 may be shorter than the distance L2 between the other end 3*b* of the heat conduction portion 3 and the inlet hole 31. Accordingly, the inlet hole 31 may be formed at a position closer to the heat source portion 2 than to the tobacco medium 4. Therefore, according to the aerosol generating article 1 according to the embodiment, the air introduced into the heat conduction portion 3 may receive high-temperature heat at a location close to the heat source portion 2. In addition, because the time for the air to flow through the inside of the heat conduction portion 3 may be increased, the time for the air to receive heat generated from the heat source portion 2 is increased. As a result, air at a relatively high temperature may reach the tobacco medium 4.

Referring to FIG. 3, the airflow path 32 may extend in a direction transverse to the longitudinal direction of the heat conduction portion 3. In this case, the air introduced into the inlet hole 31 may move in the circumferential direction of the heat conduction portion 3. Accordingly, in comparison with a case in which the airflow path 32 extends in the same direction as the longitudinal direction of the heat conduction portion 3, the aerosol generating article 1 according to an embodiment may increase the path of the airflow path 32 so that the air stays longer in the heat conduction portion 3. Therefore, because the air may receive a sufficient amount of heat from the heat source portion 2, relatively high temperature air may reach the tobacco medium 4. The airflow path 32 may extend spirally as shown in FIG. 3.

Referring to FIG. 4, the airflow path 32 may include a portion extending parallel to the longitudinal direction of the heat conduction portion 3 (i.e., the longitudinal direction of the aerosol generating article 1). In this case, the air introduced into the inlet hole 31 may flow in a direction opposite to the direction in which heat flows in the heat conduction portion 3. Accordingly, in comparison with a case in which the airflow path 32 is formed in a way that causes air only flows in a direction from the heat source portion 2 toward the tobacco medium 4, the aerosol generating article 1 according to an embodiment may increase the path of the airflow path 32 to increase the time the air stays in the heat conduction portion 3.

A barrier 33 may be disposed in the area that is not occupied by the airflow path 32 in the heat conduction portion 3. That is, the air flow path 32 may be formed in the barrier 33. The barrier 33 may block contact between the heat source 21 and the tobacco medium 4, and may prevent carbon monoxide or carbon dioxide generated from the heat source 21 from flowing into the heat conduction portion 3. As an example, the barrier 33 may include a non-metallic, non-combustible, and gas-resistant material. As another example, the barrier 33 may include a metal material such as aluminum.

The heat conduction portion 3 may be formed in a cylindrical shape as a whole, but this is an example and the heat conduction portion 3 may be formed in other shapes as long as the heat conduction portion 3 may transfer the heat generated from the heat source portion 2 to the tobacco medium 4.

Referring to FIGS. 1 to 4, the tobacco medium 4 is connected to the heat conduction portion 3. One end 4*a* of the tobacco medium 4 may be connected to the heat conduction portion 3, and the other end 4*b* (shown in FIG. 7) of the tobacco medium 4 may be connected to the aerosol moving portion 5.

The tobacco medium 4 includes an aerosol generating material that is heated by the heat generated by the heat source portion 2 to generate an aerosol.

For example, the aerosol generating material may include at least one of glycerin, propylene glycol, ethylene glycol, dipropylene glycol, diethylene glycol, triethylene glycol, tetraethylene glycol, and oleyl alcohol, but is not limited thereto. In addition, the tobacco medium 4 may contain flavoring agents, wetting agents, and/or other additive materials such as organic acids. In addition, a flavoring liquid such as menthol or a moisturizing agent may be added to the tobacco medium 4 by being sprayed onto the tobacco medium 4.

The tobacco medium 4 may be manufactured in various ways. For example, the tobacco medium 4 may be made of sheets or strands. In addition, the tobacco medium 4 may be made of a tobacco cut filler made by chopping the tobacco sheet. The tobacco medium 4 may be surrounded by a heat-conducting material. For example, the heat-conducting material may be a metal foil such as aluminum foil, but is not limited thereto. For example, the heat-conducting material surrounding the tobacco medium 4 may improve the thermal conductivity applied to a tobacco rod by evenly distributing the heat transferred to the tobacco medium 4, thereby improving the tobacco taste. In addition, the heat-conducting material surrounding the tobacco medium 4 may function as a susceptor, which is heated by an induction heater. In this case, although not shown in the drawings, the tobacco medium 4 may further include an additional susceptor in addition to the heat-conducting material surrounding the outside of the tobacco medium 4.

The tobacco medium 4 may be formed in a cylindrical shape as a whole, but this is an example and the tobacco medium 4 may be formed in other shapes as long as the tobacco medium 4 may include an aerosol generating material.

FIG. 5 is a diagram illustrating an example of a movement passage through which an aerosol moves, and FIG. 6 is a diagram illustrating another example of a movement passage through which an aerosol moves. An arrow F3 shown in FIGS. 5 and 6 schematically shows a movement direction of the aerosol flowing through a movement passage 51 formed in the aerosol moving portion 5.

Referring to FIGS. 2, 5, and 6, the aerosol moving portion 5 is connected to the tobacco medium 4. One end 5*a* (i.e., upstream end) of the aerosol moving portion 5 is connected to the tobacco medium 4, and the other end 5*b* (i.e., downstream end) of the aerosol moving portion 5 is connected to a filter 10.

Before describing the aerosol moving portion 5 in detail, the filter 10 is described as follows.

The filter 10 may be a cellulose acetate filter. The shape of the filter 10 is not limited thereto. For example, the filter 10 may be a cylindrical rod, or a tubular rod including a hollow therein. Also, the filter 10 may be a recess-type rod. If the filter 10 is composed of a plurality of segments, at least one of the plurality of segments may be manufactured in a different shape.

The filter 10 may be manufactured to generate flavor. As an example, the flavoring liquid may be injected into the filter 10, and a separate fiber, to which the flavoring liquid is applied, may be inserted into the filter 10.

Also, the filter 10 may include at least one capsule. Here, the capsule may generate flavor or aerosols. For example, the capsule may have a structure in which a liquid containing a fragrance is wrapped with a film. The capsule may have a spherical or cylindrical shape, but is not limited thereto.

If the filter 10 includes a segment for cooling the aerosol, the cooling segment may be made of a polymer material or a biodegradable polymer material. For example, the cooling segment may be made only of pure polylactic acid, but is not limited thereto. Alternatively, the cooling segment may be fabricated as a cellulose acetate filter perforated with a plurality of holes. However, the cooling segment is not limited to the example described above, and as long as the aerosol may perform the function of cooling, the cooling segment may be applicable without limitation.

Although not shown, one or more perforations for introducing external air may be formed in the filter 10. The filter 10 may be connected to a mouthpiece 20. The user may inhale the aerosol through the mouthpiece 20.

The aerosol moving portion 5 includes the movement passage 51 through which the aerosol generated in the tobacco medium 4 moves. The aerosol that has moved through the movement passage 51 may flow through the filter 10 to the mouthpiece 20.

One end of the movement passage 51 may be connected to the tobacco medium 4, and the other end of the movement passage 51 may be connected to the filter 10.

Referring to FIGS. 2, 5, and 6, the aerosol moving portion 5 may include a section in which a size of the movement passage 51 varies.

As an example, the movement passage 51 may become gradually narrower toward the filter 10. Accordingly, the speed of the aerosol passing through the movement passage 51 may be increased toward the filter 10. This increase in the speed of the aerosol is due to the Venturi effect that the fluid pressure decreases when the fluid flows through a narrow portion of the passage.

Therefore, according to an aerosol generating article 1 according to the embodiment, the speed of the aerosol reaching the filter 10 is increased, so that the user may quickly inhale the aerosol. In the embodiment shown in FIG. 2, the movement passage 51 may be formed in a tapered shape as a whole.

As another example, as shown in FIG. 5, only a part of the movement passage 51 may become gradually narrower toward the filter 10.

Referring to FIGS. 5 and 6, the movement passage 51 may include a first passage hole 511 and a second passage hole 512.

The first passage hole 511 is disposed at one end of the movement passage 51 so as to be connected to the tobacco medium 4. The second passage hole 512 is disposed at the other end of the movement passage 51 so as to be connected to the filter 10.

According to an embodiment, as shown in FIG. 5, both the second passage hole 512 and the first passage hole 511 may decrease in size toward the filter 10. Accordingly, the speed of the aerosol passing through the movement passage 51 may be gradually increased toward the filter 10. Also, as shown in FIG. 6, a section having a constant size of the movement passage 51 may be disposed between the second passage hole 512 and the first passage hole 511.

Although not shown, according to an embodiment, the second passage hole 512 and the first passage hole 511 may have a constant size in the longitudinal direction of the aerosol moving portion 5. In this case, the movement passage 51 decreases in size between the second passage hole 512 and the first passage hole 511. Accordingly, the speed of the aerosol passing through the movement passage 51 may be increased while passing between the first passage hole 511 and the second passage hole 512. In this embodiment, the second passage hole 512 may have a smaller diameter than the first passage hole 511.

Referring to FIG. 6, the aerosol moving portion 5 may include a guide surface 52.

The guide surface 52 may include a curved surface that is partially curved in the extending direction of the movement passage 51, and may induce the generated aerosol to flow along the curved surface. Accordingly, the aerosol generating article 1 according to one embodiment may have the following effects.

First, the aerosol generating article 1 according to an embodiment may achieve a so-called Coanda effect. That is, the curved surface may cause the aerosol to flow along the surface of the guide surface 52 while maintaining close contact with the guide surface 52. Therefore, the flow of the aerosol passing through the first passage hole 511 is guided toward the guide surface 52 due to the Coanda effect by the curved surface, when compared to the free flow, an attenuation of the speed of the aerosol is smaller and the aerosol may flow farther.

Second, the aerosol generating article 1 according to an embodiment also may reduce the possibility of a vortex occurring in the movement passage 51 because the residence time of the aerosol in the movement passage 51 is reduced by the guide surface 52.

Third, the aerosol produced article 1 according to one embodiment may rapidly flow the aerosol within the movement passage 51. Therefore, because the aerosol that passed the second passage hole 512 may reach the mouthpiece 20 at a relatively high temperature, the aerosol generating article 1 according to an embodiment may improve the flavor sensed by the user.

The guide surface 52 may extend from the first passage hole 511 to the second passage hole 512. Accordingly, the area through which the aerosol may readily flow along the guide surface 52 may be increased.

The guide surface 52 is disposed toward the movement passage 51. The guide surface 52 may have a convex shape toward the center of the movement passage 51. The guide surface 52 may be formed in the circumferential direction of the aerosol moving portion 5.

Referring to FIGS. 2, 5, and 6, a passage body 50 may be disposed in the area that is not occupied by the movement passage 51 in the aerosol moving portion 5. The passage body 50 may surround the movement passage 51 and may include a cellulose material.

The aerosol moving portion 5 may be formed in a cylindrical shape as a whole, but this is an example and the aerosol moving portion 5 may be formed in other shapes as long as the aerosol may flow into the filter 10.

Alternatively, the aerosol moving portion 5 may not include a movement passage 51 having a hydrodynamic shape, and may be implemented as a simple filter. In this case, the filter 10 shown in FIGS. 1, 2, 5, and 6 may be omitted.

FIG. 7 is a view showing an example of a first heat conductor disposed inside the tobacco medium 4, and FIG. 8 is a view illustrating a plurality of first heat conductors disposed inside the tobacco medium 4 as viewed from line VIII-VIII of FIG. 2.

Referring to FIGS. 2, 7, and 8, the first heat conductor 6 is arranged in the tobacco medium 4. The first heat conductor 6 includes a heat-conducting material for transferring heat generated by the heat source portion 2 to the tobacco medium 4. For example, the first heat conductor 6 may include a metal material such as copper, aluminum, or stainless steel (SUS).

The first heat conductor 6 may be inserted into the tobacco medium 4. Accordingly, in contrast to the example in which the first heat conductor 6 is disposed outside the tobacco medium 4 or in the circumferential direction of the tobacco medium 4, the aerosol generating article 1 according to one embodiment may efficiently heat an aerosol generating material located inside the tobacco medium 4. For example, the first heat conductor 6 may be inserted into the center of the tobacco medium 4.

The first heat conductor 6 may be formed in a cylindrical shape extending in the longitudinal direction of the tobacco medium 4 as a whole. However, this is an example, and the first heat conductor 6 may be formed in a rectangular columnar shape as long as the first heat conductor 6 may transfer heat generated from the heat source portion 2 to the tobacco medium 4.

The size of the first heat conductor 6 may have a tapered shape so that the first heat conductor 6 may be easily inserted into the tobacco medium 4. For example, the end of the first heat conductor 6 may be formed to be sharp.

The first heat conductor 6 may be in contact with one end 4*a* of the tobacco medium 4, as shown in FIGS. 7 and 9 to 11. Accordingly, the first heat conductor 6 may efficiently receive heat from the heat conduction portion 3.

Referring to FIG. 7, the first heat conductor 6 may extend from one end 4*a* of the tobacco medium 4 to the other end 4*b* of the tobacco medium 4. Accordingly, the aerosol generating article 1 according to an embodiment may increase the heat absorption capacity of the first heat conductor 6 capable of absorbing heat generated from the heat source portion 2. In addition, the aerosol generating article 1 according to an embodiment may improve the bearing capacity for supporting the tobacco medium 4 and may increase the amount of heat transferred to the tobacco medium 4.

Because the tobacco medium 4 is connected to the aerosol moving portion 5, the first heat conductor 6 disposed in the tobacco medium 4 may transfer heat generated by the heat source portion 2 to the aerosol moving portion 5. Accordingly, the aerosol generating article 1 according to an embodiment may increase the amount of heat transferred to the aerosol moving portion 5 to increase the temperature of the aerosol moving portion 5, so the fluidity of the aerosol flowing through the movement passage 51 may be improved.

Referring to FIG. 8, a plurality of first heat conductors 6 may be disposed in the circumferential direction of the tobacco medium 4. In this case, the plurality of first heat conductors 6 may be disposed spaced apart from each other. Accordingly, the aerosol generating article 1 according to an embodiment may increase the absorption capacity for absorbing heat generated from the heat source portion 2. In addition, the aerosol generating article 1 according to an embodiment may improve the bearing capacity for supporting the tobacco medium 4, and may increase the amount of heat transferred to the aerosol moving portion 5. Although four first heat conductors 6 are shown in FIG. 8, two, three, or five or more first heat conductors 6 may be disposed inside the tobacco medium 4.

Although not shown, the first heat conductor 6 may be spaced apart from both ends 4*a* and 4*b* of the tobacco medium 4. That is, the first heat conductor 6 may be disposed so as not to contact the one end 4*a* and the other end 4*b* of the tobacco medium 4.

FIG. 9 is a view showing an example of a second heat conductor 7 disposed on the outside of the tobacco medium 4, and FIG. 10 is a view illustrating an example of a second heat conductor 7 disposed on the outside of the heat conduction portion 3 and the tobacco medium 4.

Referring to FIGS. 9 and 10, the aerosol generating article 1 according to an embodiment may further comprise a second heat conductor 7.

The second heat conductor 7 is arranged to surround at least a portion of the outer surface of the heat conduction portion 3 and at least a portion of the outer surface of the tobacco medium 4. The second heat conductor 7 may be disposed in the circumferential direction of the heat conduction portion 3 and the tobacco medium 4.

The second heat conductor 7 includes a heat-conducting material for transferring heat generated from the heat source portion 2 to the heat conduction portion 3 and the tobacco medium 4. For example, the second heat conductor 7 may include a metal material such as copper, aluminum, or stainless steel.

The aerosol generating article 1 according to an embodiment includes the second heat conductor 7, thereby achieving the following effects.

First, because the second heat conductor 7 is disposed around the heat conduction portion 3 and the tobacco medium 4, the amount of heat escaping to the outside of the heat conduction portion 3 and the tobacco medium 4 may be reduced. In addition, the second heat conductor 7 may absorb the heat transferred from the heat source portion 2 to maintain the temperature of the heat conduction portion 3 and the tobacco medium 4, thereby improving the overall thermal insulation performance. Moreover, the second heat conductor 7 may raise the temperature of the outer portion of the tobacco medium 4 while the first heat conductor 6 may raise the temperature of the inner portion of the tobacco medium 4, so an aerosol may be more easily generated from the aerosol generating material included in the tobacco medium 4.

Second, according to the aerosol generating article 1 according to an embodiment, the second heat conductor 7 may perform a function of supporting the outer portion of the heat conduction portion 3 and the tobacco medium 4. Therefore, even if an external force such as an impact acts on the heat conduction portion 3 and the tobacco medium 4, the heat conduction portion 3 and the tobacco medium 4 may be not be easily broken. Moreover, because the second heat conductor 7 supports the outer portion of the tobacco medium 4 and the first heat conductor 6 supports the inner portion of the tobacco medium 4, the bearing capacity for supporting the aerosol generating article 1 according to an embodiment may be improved.

Third, the aerosol generating article 1 according to an embodiment may increase the amount of heat transferred to the heat conduction portion 3 and the tobacco medium 4 through the second heat conductor 7 including a heat-conducting material. Therefore, according to the aerosol generating article 1 according to an embodiment, the second heat conductor 7 may improve the fluidity of the air inside the heat conduction portion 3 and may improve the fluidity of the aerosol generated by the tobacco medium 4.

The second heat conductor 7 may extend in a longitudinal direction of the tobacco medium 4. For example, the second heat conductor 7 may extend from one end 4*a* of the tobacco medium 4 to the other end 4*b* of the tobacco medium 4.

Although not shown, the second heat conductor 7 may be disposed around a part of the heat conduction portion 3. In this case, the second heat conductor 7 may be disposed apart from the inlet hole 31 so as not to cover the inlet hole 31.

In addition, the second heat conductor 7 may extend from one end 3*a* of the heat conduction portion 3 to the other end 4*b* of the tobacco medium 4. In this case, a connection hole (not shown) for communicating with the inlet hole 31 may be formed in the second heat conductor 7.

The second heat conductor 7 may be formed in a hollow cylindrical shape as a whole. However, this is an example, and the second heat conductor 7 may be formed in other shapes as long as the second heat conductor 7 may surround at least a portion of the outer surface of the heat conduction portion 3 and at least a portion of the outer surface of the tobacco medium 4.

Because the tobacco medium 4 is connected to the aerosol moving portion 5, the second heat conductor 7 surrounding the outer surface of the tobacco medium 4 may transfer heat generated by the heat source portion 2 to the aerosol moving portion 5. Accordingly, the aerosol generating article 1 according to an embodiment may increase the amount of heat transferred to the aerosol moving portion 5. As a result, the temperature of the aerosol moving portion 5 may be increased, and the fluidity of the aerosol flowing through the movement passage 51 may be improved.

FIG. 11 is a view showing an example of a third heat conductor 8 disposed inside the heat conduction portion 3, FIG. 12 is a view showing that the first heat conductor 6 is connected to the third heat conductor 8, and FIG. 13 is a view illustrating another example of a third heat conductor 8 disposed inside the heat conduction portion 3. An arrow F2 shown in FIGS. 11 to 13 schematically shows the flow direction of the external air flowing through the airflow path 32.

Referring to FIGS. 11 to 13, the aerosol generating article 1 according to an embodiment may further comprise a third heat conductor 8.

The third heat conductor 8 is arranged in the heat conduction portion 3. The third heat conductor 8 includes a heat conductive material for transferring heat generated from the heat source portion 2 to at least one of the heat conduction portion 3 and the tobacco medium 4. For example, the third heat conductor 8 may include a metal material such as copper, aluminum, or stainless steel.

Accordingly, the heat generated by the heat source portion 2 may be efficiently transferred to the tobacco medium 4. In addition, because the third heat conductor 8 may transfer the heat generated from the heat source portion 2 to the air introduced through the inlet hole 31, the air inside the airflow path 32 may receive heat from the third heat conductor 8 and flow while maintaining a relatively high temperature.

The third heat conductor 8 may be inserted into the heat conduction portion 3. The third heat conductor 8 may be inserted into the barrier 33. For example, the third heat conductor 8 may be inserted into the center of the heat conduction portion 3.

As an example, the third heat conductor 8 may be disposed inside the heat conduction portion 3 so as to be in contact with the airflow path 32. As another example, the third heat conductor 8 may be disposed apart from the airflow path 32 inside the heat conduction portion 3.

The third heat conductor 8 may be formed in a cylindrical shape extending in the longitudinal direction of the heat conduction portion 3. However, this is only an example, and the third heat conductor 8 may be formed in a rectangular column shape as long as the third heat conductor 8 may transfer the heat generated from the heat source portion 2 to the tobacco medium 4 and air.

The size of the third heat conductor 8 may be decreased toward the end. Accordingly, the third heat conductor 8 may be easily inserted into the heat conduction portion 3. For example, the end of the third heat conductor 8 may be formed to be sharp as shown in FIG. 11.

The third heat conductor 8 may be in contact with one end 3*a* of the heat conduction portion 3 as shown in FIGS. 11 to 13. Therefore, the third heat conductor 8 may efficiently receive heat from the heat source portion 2.

Referring to FIG. 12, the third heat conductor 8 may extend from one end 3*a* of the heat conduction portion 3 to the other end 3*b* of the heat conduction portion 3. Accordingly, the aerosol generating article 1 according to an embodiment may increase the heat absorption capacity of the third heat conductor 8 capable of absorbing heat generated from the heat source portion 2. In addition, the aerosol generating article 1 according to an embodiment may improve the bearing capacity for supporting the heat conduction portion 3 and may increase the amount of heat transferred to the heat conduction portion 3 and the tobacco medium 4.

When the third heat conductor 8 extends from one end 3*a* of the heat conduction portion 3 to the other end 3*b* of the heat conduction portion 3, the third heat conductor 8 may be connected to the first heat conductor 6 as shown in FIG. 12. In this case, the heat absorbed by the third heat conductor 8 may be transferred directly to the first heat conductor 6. In addition, the bearing capacity for supporting the heat conduction portion 3 and the tobacco medium 4 may be improved.

In the embodiment shown in FIG. 12, the third heat conductor 8 may be integrated with the first heat conductor 6 to form one body.

Although not shown, a plurality of third heat conductors 8 may be disposed in the circumferential direction of the heat conduction portion 3. In this case, the plurality of third heat conductors 8 may be disposed apart from each other inside the heat conduction portion 3.

In addition, the third heat conductor 8 may be spaced apart from both ends 3*a* and 3*b* of the heat conduction portion 3. That is, the third heat conductor 8 may be disposed so as not to contact the one end 3*a* and the other end 3*b* of the heat conduction portion 3.

Referring to FIG. 13, the third heat conductor 8 may include a shielding member 81.

The shielding member 81 extends in a direction transverse to the lengthwise direction of the heat conduction portion 3. In this case, the airflow path 32 may include a section which extends parallel to the direction in which the shielding member 81 extends.

Therefore, in comparison with a case in which the airflow path 32 does not include such a section, the aerosol generating article 1 according to an embodiment may increase the path of the airflow path 32 to increase the time the air stays in the heat conduction portion 3. For example, the shielding member 81 may extend in the radial direction of the heat conduction portion 3.

The shielding member 81 may be formed in the shape of a disk as a whole. However, this is only an example, and the shielding member 81 may be formed in the shape of a square plate as long as the shielding member 81 may extend in a direction transverse to the lengthwise direction in which the heat conduction portion 3 extends.

The shielding member 81 is disposed at an end of a main body 80 of the third heat conductor 8. The shielding member 81 may be integrated with the main body 80 to form one body. The main body 80 of the third heat conductor 8 may extend in a longitudinal direction of the heat conduction portion 3.

FIGS. 14 and 15 are views illustrating examples in which an aerosol generating article according to an embodiment is inserted into an aerosol generating device.

Referring to FIGS. 14 and 15, an aerosol generating system 200 according to an embodiment includes an aerosol generating article 1 according to an embodiment, and an aerosol generating device 100.

Referring to FIG. 14, the aerosol generating device 100 may include a battery 110, a controller 120, and a heater 130.

Referring to FIGS. 14 and 15, the aerosol generating article 1 may be inserted into an inner space of the aerosol generating device 100.

FIGS. 14 and 15 illustrate components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIGS. 14 and 15.

In addition, although it is illustrated that the heater 130 is included in the aerosol generating device 100 in FIGS. 14 and 15, the heater 130 may be omitted if necessary.

FIGS. 14 and 15 illustrates that the battery 110, the controller 120, and the heater 130 are arranged in series. However, the internal structure of the aerosol generating device 100 is not limited to the structures illustrated in FIGS. 14 and 15. In other words, according to the design of the aerosol generating device 100, the battery 110, the controller 120, and the heater 130, may be differently arranged.

When the aerosol generating article 1 is inserted into the aerosol generating device 100, the aerosol generating device 100 may operate the heater 130 to ignite or burn the heat source 21. The heat generated from the heat source 21 may be transferred to the tobacco medium 4, and the aerosol generating material included in the tobacco medium 4 may be heated to generate an aerosol.

Meanwhile, the embodiments are not limited by the implementation method of the heater 130, and may include other modifications as long as the heater 130 may ignite or burn the heat source 21. For example, the heater 130 may ignite or burn the heat source 21 by arc heating. In this case, the heater 130 may include a plurality of electrodes.

As necessary, even when the aerosol generating article 1 is not inserted into the aerosol generating device 100, the aerosol generating device 100 may heat the heater 130.

The battery 110 may supply power to be used for the aerosol generating device 100 to operate. For example, the battery 110 may supply power to heat the heater 130 or the vaporizer 140, and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110, the heater 130, and the vaporizer 140, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 130 may be heated by the power supplied from the battery 110. For example, when the aerosol generating article 1 is inserted into the aerosol generating device 100, the heater 130 may be located outside the aerosol generating article 1. Thus, the heated heater 130 may increase a temperature of an aerosol generating material in the aerosol generating article 1.

The heater 130 may include an electro-resistive heater. For example, the heater 130 may include an electrically conductive track, and the heater 130 may be heated when currents flow through the electrically conductive track. However, the heater 130 is not limited to the example described above and may include all heaters which may be heated to a desired temperature. Here, the desired temperature may be pre-set in the aerosol generating device 100 or may be set by a user.

As another example, the heater 130 may include an induction heater. In detail, the heater 130 may include an electrically conductive coil for heating an aerosol generating article in an induction heating method, and the aerosol generating article may include a susceptor which may be heated by the induction heater.

For example, the heater 130 may include a tube-type heating element, a plate-type heating element, a needle-type heating element, or a rod-type heating element, and may heat the inside or the outside of the aerosol generating article 1, according to the shape of the heating element.

Also, the aerosol generating device 100 may include a plurality of heaters 130. Here, the plurality of heaters 130 may be inserted into the aerosol generating article 1 or may be arranged outside the aerosol generating article 1. Also, some of the plurality of heaters 130 may be inserted into the aerosol generating article 1 and the others may be arranged outside the aerosol generating article 1. In addition, the shape of the heater 130 is not limited to the shapes illustrated in FIGS. 14 through 15 and may include various shapes.

The aerosol generating device 100 may further include general-purpose components in addition to the battery 110, the controller 120, and the heater 130. For example, the aerosol generating device 100 may include a display capable of outputting visual information and/or a motor for outputting haptic information. Also, the aerosol generating device 100 may include at least one sensor (a puff sensor, a temperature sensor, an aerosol generating article insertion detecting sensor, etc.). Also, the aerosol generating device 100 may be formed as a structure that, even when the aerosol generating article 1 is inserted into the aerosol generating device 100, may introduce external air or discharge internal air.

Although not illustrated in FIGS. 14 through 15, the aerosol generating device 100 and an additional cradle may form together a system. For example, the cradle may be used to charge the battery 110 of the aerosol generating device 100. Alternatively, the heater 130 may be heated when the cradle and the aerosol generating device 100 are coupled to each other.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating article comprising:

a heat source portion including a combustible heat source for generating heat;

a heat conduction portion connected to the heat source portion and including an inlet hole configured to introduce external air;

a tobacco medium connected to the heat conduction portion, including an aerosol generating material that generates an aerosol when heated, and configured to receive the heat through the heat conduction portion; and a first heat conductor disposed in the tobacco medium and including a heat-conducting material for transferring the heat to the tobacco medium, wherein the heat conduction portion comprises:

an airflow path, wherein the airflow path is a passage through which air can flow and that is connected to each of the inlet hole and the tobacco medium; and a barrier in which the air flow path is formed and that blocks contact between the heat source and the tobacco medium, the airflow path formed in the barrier including a portion extending a direction transverse to a lengthwise direction of the heat conduction portion.

2. The aerosol generating article of claim 1, wherein the first heat conductor is disposed inside the tobacco medium.

3. The aerosol generating article of claim 1, wherein the first heat conductor extends from one end of the tobacco medium to another end of the tobacco medium.

4. The aerosol generating article of claim 1, wherein a plurality of first heat conductors are disposed in a circumferential direction of the tobacco medium.

5. The aerosol generating article of claim 1, further comprising:

a second heat conductor surrounding at least a portion of an outer surface of the tobacco medium and at least a portion of an outer surface of the heat conduction portion.

6. The aerosol generating article of claim 1, further comprising:

a third heat conductor that is disposed in the heat conduction portion and configured to transfer the heat generated from the heat source portion to at least one of the heat conduction portion and the tobacco medium.

7. The aerosol generating article of claim 6, wherein the third heat conductor includes a shielding member extending in a direction transverse to a lengthwise direction of the heat conduction portion, and the airflow path includes a portion extending in an extension direction of the third heat conductor.

8. The aerosol generating article of claim 6, wherein the third heat conductor extends from one end of the heat conduction portion to another end of the heat conduction portion such that the third heat conductor is connected to the first heat conductor.

9. The aerosol generating article of claim 1, wherein the inlet hole is disposed closer to the heat source portion than to the tobacco medium.

10. The aerosol generating article of claim 1, further comprising:

an aerosol moving portion connected to the tobacco medium and including a movement passage through which the generated aerosol moves, wherein the aerosol moving portion includes a section in which a size of the movement passage decreases as a distance from the tobacco medium increases.

11. The aerosol generating article of claim 1, further comprising:

an aerosol moving portion connected to the tobacco medium and including a movement passage through which the generated aerosol moves, wherein one end of the aerosol moving portion is connected to the tobacco medium, and the movement passage includes a first passage hole disposed at one end of the aerosol moving portion, and a second passage hole disposed at another end of the aerosol moving portion and having a smaller size than the first passage hole.

12. The aerosol generating article of claim 1, further comprising:

an aerosol moving portion connected to the tobacco medium and including a movement passage through which the generated aerosol moves, wherein the movement passage includes a curved surface configured to induce the aerosol to flow along the curved surface according to Coanda effect.

13. An aerosol generating system comprising:

the aerosol generating article according to claim 1 and a heater configured to heat the heat source portion to generate the heat.

14. An aerosol generating article comprising:

a heat source portion including a combustible heat source for generating heat;

a heat conduction portion connected to the heat source portion and including an inlet hole configured to introduce external air;

a tobacco medium connected to the heat conduction portion, including an aerosol generating material that generates an aerosol when heated, and configured to receive the heat through the heat conduction portion; and a first heat conductor disposed in the tobacco medium and including a heat-conducting material for transferring the heat to the tobacco medium, wherein the heat conduction portion includes an airflow path that guides the external air introduced through the inlet hole to the tobacco medium, and the airflow path extends in a direction transverse to a lengthwise direction of the heat conduction portion such that the external air introduced through the inlet hole moves in a circumferential direction of the heat conduction portion.

15. An aerosol generating article comprising:

a heat source portion including a combustible heat source for generating heat;

a heat conduction portion connected to the heat source portion and including an inlet hole configured to introduce external air;

a tobacco medium connected to the heat conduction portion, including an aerosol generating material that generates an aerosol when heated, and configured to receive the heat through the heat conduction portion; and a first heat conductor disposed in the tobacco medium and including a heat-conducting material for transferring the heat to the tobacco medium, wherein the heat conduction portion comprises:

an airflow path, wherein the airflow path is a passage through which air can flow and that is connected to each of the inlet hole and the tobacco medium; and a barrier in which the air flow path is formed and that blocks contact between the heat source and the tobacco medium, wherein the airflow path includes a portion that guides the external air introduced through the inlet hole in a direction from the tobacco medium toward the heat source portion.

* * * * *